US006420950B1

(12) United States Patent
Kleinert et al.

(10) Patent No.: US 6,420,950 B1
(45) Date of Patent: Jul. 16, 2002

(54) ELECTROMAGNET

(75) Inventors: Dieter Kleinert, Memmingen; Georg Scherer, Kirchheim; Reinhard Häring, Lauben; Helmut Mang, Memmingen; Manfred Hanka, Woringen, all of (DE)

(73) Assignee: Dipl.-Ing. Schultz, Wolfgang E., Memmingen (DE)

( * ) Notice: Subject to any disclaimer, the term of this patent is extended or adjusted under 35 U.S.C. 154(b) by 0 days.

(21) Appl. No.: 09/697,308

(22) Filed: Oct. 27, 2000

(30) Foreign Application Priority Data

Oct. 27, 1999 (DE) ..... 199 51 828

(51) Int. Cl.[7] ..... H01F 7/08
(52) U.S. Cl. ..... 335/260; 335/282
(58) Field of Search ..... 335/78–86, 128, 335/251, 255, 260, 281, 282, 299; 336/196, 192, 198

(56) References Cited

U.S. PATENT DOCUMENTS 4,639,704 A * 1/1987 Shand et al. ..... 335/255
6,211,761 B1 * 4/2001 Yoshino et al. ..... 335/282

FOREIGN PATENT DOCUMENTS

DE 3709474 C1 3/1988
DE 4426152 C2 3/1996

* cited by examiner

*Primary Examiner*—Lincoln Donovan
(74) *Attorney, Agent, or Firm*—Jacobson Holman, PLLC

(57) ABSTRACT

The invention relates to an electromagnet, the armature space of which is connected via a venting duct to the environment. It is proposed to provide a siphon in the venting duct.

17 Claims, 1 Drawing Sheet

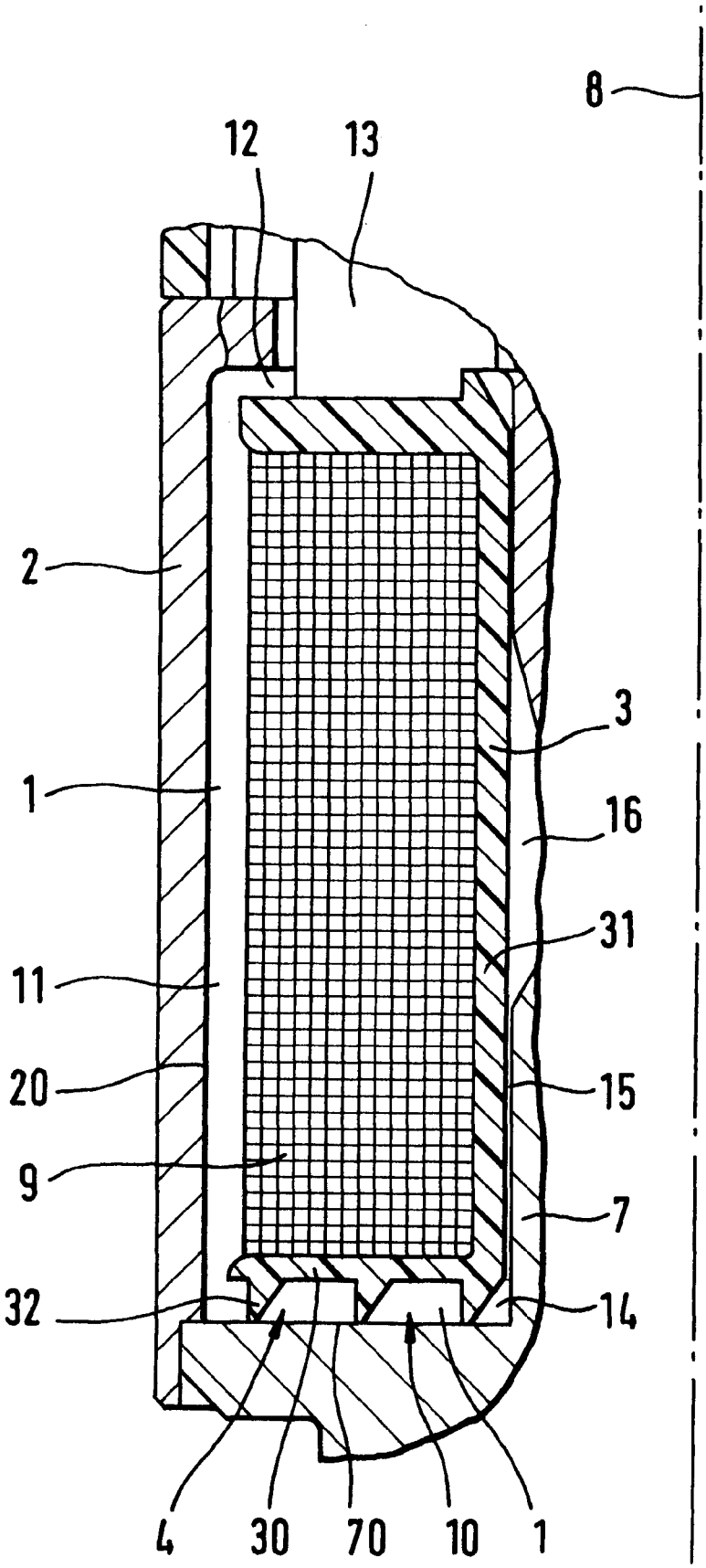
8
12
13
2
3
1
16
31
11
20
15
9
7
32
14
4
30
70
10
1

ELECTROMAGNET

BACKGROUND OF THE INVENTION

The invention relates to an electromagnet consisting of an armature movable in an armature space and a coil which can be loaded with current, this coil, when loaded with current, producing a magnetic field which serves to move the armature, a venting duct being provided in order to vent the armature space.

Electromagnets as described above are used, for example, as an actuating drive in pressure control valves. Such pressure control valves are used, for example, in hydraulic circuits. Typical areas of application are, in this case, for example, automatic gears for the construction of vehicles. With the aforementioned pressure control valves a control edge is adjusted in relation to a through-flow by the position of the armature and therefore a throttle which can be altered in its feed-through is created. The pressure can be adjusted by this throttling.

It is expected of the above-mentioned pressure control valves that these have a constant, weak hysteresis and oscillation-stable pressure control characteristic curve. The pressure control characteristic curve is, in this case, a function of the position of the armature in the electromagnet. The function can be described as follows:

p=f [I] with I: current intensity of the current flowing through the electromagnet In order to achieve such a pressure control characteristic curve it is known that the armature space is to be vented. The armature space refers in this case to the space in the interior of the electromagnet in which the armature, which supports the control element to regulate the through-flow on its one end, moves. It is known to arrange a venting duct for the purpose of venting the armature space by virtue of which venting duct rapid pressure compensation with respect to the environment is possible. However, the arrangement of the venting duct also causes problems however. Often the electromagnets are operated in regions which have a relatively high degree of soiling. As described, a typical area of application for these electromagnets is the application in automatic gears where the electromagnets are used in an environment with hydraulic oils. Typically the oils used here are also enriched with metal abrasions and other substances and there is the danger that contaminated oil will penetrate into the interior of the device via the venting duct. In particular, the solid components transported in as a result can lead to additional wear in the armature space, which impairs the service life and the reliability of the electromagnet and the pressure control valve driven or controlled thereby.

It is an object of the present invention to reduce the wear of the above-mentioned electromagnet and to increase the service life of the electromagnet and the elements controlled thereby as a result.

BRIEF DESCRIPTION OF THE INVENTION

The invention provides an electromagnet consisting of an armature movable in an armature space and a coil which can be loaded with current, said coil, when loaded with current, producing a magnetic field serving to move said armature, a venting duct being provided in order to vent said armature space, wherein a siphon is provided in said venting duct.

Owing to the development according to the invention, on the one hand a fluid or oil column located in the venting duct is produced in which dirt particles which have been entrained collect, and therefore the particle entrainment into the armature space is avoided. The oil column which forms is then pushed to and fro in the venting duct or in the siphon as a result of the pressure wave caused by the armature movement. According to the invention, however, it is also not imperative that a fluid column, for example of hydraulic medium or oil, forms in the siphon in order to avoid abrasion products from outside reaching the armature space. The same effect can also be achieved in that the siphon is formed as a labyrinth, the venting duct in this case describing a relatively long path in the electromagnet. The penetrating contaminated oil must also traverse this long path in order to reach the armature space from the outside, the probability of penetration of contaminated oil or dirt into the armature space being adjustable by the length of the path.

Furthermore, it is preferred that the siphon is a part of the venting duct. Such a design facilitates the production of an electromagnet according to the invention since by a corresponding development of the venting duct, the siphon or the siphon effect is achieved. Alternatively, it is of course also possible to realise the siphon as a separate component in an electromagnet and to integrate this, for example, in the venting duct or to attach the siphon to the venting duct.

In a preferred development of the invention it is provided that the duct direction in the siphon is formed, at least in portions, in relation to the movement direction of the armature, concentrically, helically and/or spirally. Alternatively, it is also possible that the flow direction in the siphon is formed, at least in portions, in relation to an assembly direction, concentrically, helically and/or spirally. The electromagnet is connected, for example, via a screw connection to the valve connection and the entire constructional unit is connected, for example, likewise via a screw connection, to the gearing or to the hydraulic conduit to be controlled. As a result of the complexity of the areas of application of the aforementioned electromagnets or pressure control valves, it is necessary that independent positioning of the electromagnet is possible in relation to the assembly direction or the movement direction of the armature. This is to ensure that operation of the electromagnet is as reliable as possible in every instance of positioning. In the electromagnet according to the invention, the siphon is, at least in portions, as described, concentric, helical and/or spiral in relation to the given directions so that an arrangement of the electromagnet which is independent of position is ensured which permits reliable operation of the electromagnet every time, however, as the siphon effect in a concentric or spiral development of the duct direction permits the formation of a fluid column independent of the position and therefore the desired effect of a filtering or buffering of the hydraulic fluid or oil mixed with particles is produced. The usability and flexibility of the electromagnet according to the invention equipped in this way is, surprisingly, clearly increased.

In this case it is not imperative that a fluid column forms. In the electromagnet according to the invention it is also possible to form a labyrinth-type broad path for the venting duct.

In the electromagnet according to the invention, it is provided that the siphon is arranged on or in the coil element, in particular on the coil element flange. The coil element bears the coil and is constructed in the manner of a capstan, flanges projecting at the end connecting to a tubular piece which bears the coil. The coil element is optionally also encapsulated, in other words, a cylinder with greater diameter is pushed onto the complete coil and thereby protects the coil. This capsule covering belongs, in this case, to the coil element. The siphon can now, for example, be arranged on the coil element flange on the inner tube or the outer capsule covering.

In this case, it has turned out to be advantageous if the siphon is formed as a groove, in particular as an annular or a helical groove, on the coil element flange. A site is chosen for the arrangement of the siphon in which the other properties of the electromagnet are not affected. At the same time it is easily possible to incorporate the groove into the flange of the coil element during its production, The flange or coil element consists, in this case, for example, of a plastics material and the groove can in this case be moulded-on. It is of course also possible to incorporate the groove by means of machine processing.

Alternatively, it is provided that a helical groove is provided on the coil element as a siphon. The arrangement of this helical groove can in this case be provided on the coil element, on the inner tube or on the outer capsule covering, It is also possible, in a variation according to the invention, to arrange the siphon on the housing inner wall, a helical groove also being provided here, for example, As the housing covers the entire electromagnet, the housing has an internal diameter which is even greater than that of the coil. A path for the venting duct, which is relatively very long, which path is arranged on the housing inner wall as an annular or helical groove, results from this.

In the above-mentioned variations it is possible to make an angular length of only 90°, approximately 360° or a multiple thereof, which means, in the same manner it is possible to provide a helical or annular groove only in portions or to let this run over a plurality of rotations.

As a rule the venting duct is connected to the medium surrounding the housing. In certain developments of the electromagnet the outlet opening of the venting duct is, for example, in the region of the electrical connections. As there is often good accessibility in this region and the electrical connections are also often oriented such that these do not get very dirty, it is preferable to arrange the outlet region of the venting duct at this point, as this is not moistened to any great degree by contaminated oil. The region of the electrical connections is located, in relation to the movement of the armature on the housing at the top or at the bottom, space for the arrangement of the siphon, for example as a labyrinth path or helical arrangement, being possible in this housing region.

Methods of construction are also known in which the venting duct is guided via the armature or the armature rod. As a result of the relatively short lengths of the venting duct in the state of the art, there is also a great danger here that contaminated oil can penetrate into the armature space. However, it is also possible here to provide a siphon on or in the armature or armature rod. This can be arranged, for example, as a helical groove in the armature or the armature rod. It is, however, also possible to provide two optionally parallel holes in the armature which extend longitudinally in order to thereby realise a labyrinth path as a siphon.

An armature guide is provided in the electromagnets for guiding the armature. The armature guide is also used in a variation according to the invention to receive a siphon, the siphon being arranged in or on the armature guide. For example, it is possible to arrange holes as a venting duct in the material which the guide face for the armature provides, which holes are arranged in the manner of a siphon. It is, for example, also possible to provide a helical groove in the armature guide face.

It is clear that the concept of a helically or concentrically guided elliptical duct also encompasses a helical line-type venting duct.

The invention relates not only to an electromagnet alone, but is also directed in the same manner to a pressure control valve which is equipped with an electromagnet as described above. The area of application of such pressure control valves is, as described, often in the automotive industry at sites at which there is a relatively high degree of soiling of the environment and at which the danger of an impairment of the properties of the magnet, as a result of dirt which has penetrated the armature space, is very great. In this case it is possible to use the effect according to the invention both where the effect of the electromagnet is increasing and where it is decreasing. Furthermore, however, the area of application of the electromagnet according to the invention is not restricted to pressure control valves but embraces all possible fields.

BRIEF DESCRIPTION OF THE DRAWING

In the drawing the invention is shown schematically in an illustration in section, which is greatly enlarged.

In the sectional illustration of the invention reference is only made to the essential components of the invention. The remaining construction of the electromagnet is as customary, reference being made at this point to the German patent application 198 05 049.6 by the same Applicant in its entirety.

DETAILED DESCRIPTION

As a rule, armatures, coil elements 3 and coils 9 are arranged symmetrically about a central axis 8. The central axis 8 at the same time describes the movement direction of the armature which is not shown. The venting duct 1 serves to vent the armature space which is not shown, which venting duct, as illustrated here, consists of a plurality of partial sections. The mouth 16 is turned towards the armature space, which mouth leads into a gap 15. The gap 15 is produced between the coil element 3, in particular here, the coil inner tube 31, and the armature guide block 7. The gap 15 extends in the development illustrated in the drawing downwards to the end of the coil element 3 and there runs into an inlet region 14.

In the development of the invention shown here, the siphon 4 is arranged as a groove 10 or helical groove on the flange 30 of the coil element 3. As a result of the rotationally symmetrical arrangement (about the axis of symmetry 8) a labyrinth-type venting duct 1 is produced which runs round the axis of symmetry 8 (corresponding to the movement direction of the armature not shown).

At the end of the groove 10, in the external region in relation to the axis of symmetry 8, a duct 11 adjoins which is produced between the housing 2 and the coil 9. The duct 11 runs, in this case, parallel to the axis of symmetry 8 and extends over the entire height of the coil 9, in order to terminate in the upper region in a discharge hole 12. A region 13 adjoins the discharge hole 12 under a, for example, partially loose-fitting housing lid, which is not shown, through which the venting of the environment then takes place.

As already described, different variations are possible for the development of the siphon 4. It has also been indicated that the siphon 4 is to be provided in the region of the housing interior wall 20. This can then, for example, be realised by a concentric groove or else by a helical groove. In addition to the siphon effect, which is characterised by the fact that a fluid column forms in the venting duct 1 in its place, the siphon effect also exists, however, in a relatively long design of the venting duct 1.

In order to reliably achieve the path or the design of the fluid column in a defined manner, in the example shown here sealing measures for the groove 10 with respect to the adjacent groove and with respect to other structural components are undertaken in the flange region 30, The groove 10 is limited in the example shown here on three sides by material from the coil element 3 and the flange 30. The flange material 30 is in this case, for example, plastics material, metal can however also be used if this does not impair the magnetic properties too severely. The groove, or the groove ribs 32, are moulded-on in this case (plastics material) or worked from a machining process. The groove 10 is sealed in this case by a bearing face 70 which is provided as a boundary face of the armature guide block 7 in the region of the coil 9 or of the coil element 3. In order to achieve a reliable seal, the groove ribs 32 taper to a point here so that these produce a sealing effect which is as good as possible in conjunction with the corresponding bearing face 70. Similar measures can of course be taken in the region of the inner tube 31 of the coil element 3 or on the housing inner wall 20. It is of course also possible here that the groove is not only worked into the coil element 3 but is also located on the armature guide block or the corresponding faces or, as already indicated, in the housing inner wall 20.

Owing to the development according to the invention a type of installation is achieved which is not dependent on position. Generally, contaminated oil which has penetrated collects at the deepest point of the venting duct. Owing to the siphon 4 being arranged all round the axis of symmetry 8, the exact installation position no longer matters; the hydraulic fluid column forms at the deepest point and constitutes a siphon effect there, In the embodiment shown here the groove 10 describes approximately two complete rotations about the central axis 8. According to the invention, however, it is also possible to provide this only in a partial region of a circular arc segment (for example 90° or 180°).

It was described that the siphon 4 can also be arranged in the region of the electrical connections. The free space in the region 13 below the housing lid serves this purpose for example.

The claims submitted now with the application and later are attempts at wording without precedence, for the achievement of extensive protection.

The references made in the dependent claims refer to the further development of the subject of the main claim by the features of the respective sub-claims. These are not however to be understood as a renunciation of the obtainment of an independent objective protection for the features of the sub-claims referred to.

Features which were hitherto disclosed only in the description, can be claimed in the course of the process as being of essential importance to the invention, for example, for the purpose of differentiation from the state of the art.

What is claimed is:

1. An electromagnet assembly comprising:

an armature guide block for guiding an armature movable around a control axis, a coil for receiving a current, said coil, with said current, producing a magnetic field to move the armature, a coil element for supporting said coil, a venting duct provided to vent said armature space and receive fluid formed therein, a siphon provided in said venting duct for siphoning the fluid from said venting duct away from said coil, and a direction of siphoning in said venting duct is formed toward said siphon, and at least partially concentrically, helically and/or spirally in relation to a movement of direction of said armature.

2. The electromagnet according to claim 1, wherein said siphon is formed by said venting duct.

3. The electromagnet according to claim 1, wherein the direction of said duct in siphon is formed, at least partially concentrically, helically and/or spirally in relation to a direction around said central axis.

4. The electromagnet according to claim 1, wherein said coil is arranged on a coil element and/or said coil is enclosed by a housing.

5. The electromagnet according to claim 4, wherein said siphon is arranged on or in said coil element.

6. The electromagnet according to claim 5, wherein said coil element includes a coil element flange and said siphon is arranged on or in said coil element flange.

7. The electromagnet according to claim 6, wherein said siphon is formed as a groove on the coil element flange.

8. The electromagnet according to claim 7, wherein said groove is an annular groove.

9. The electromagnet according to claim 5, wherein an at least partially surrounding helical groove is provided as said siphon on said coil element.

10. The electromagnet according to claim 4, wherein an at least partially surrounding helical groove is provided as said siphon on the housing inner wall.

11. The electromagnet according to claim 7, wherein said groove includes a wall formed on an end remote from said coil element and tapers to a point.

12. The electromagnet according to claim 7, wherein said groove is enclosed or sealed in the manner of a duct by an element or face.

13. The electromagnet according to claim 1, wherein said siphon is arranged in a region having electrical connections.

14. The electromagnet according to claim 1, wherein said siphon is provided in said armature guide block.

15. The electromagnet according to claim 1, wherein said siphon is arranged on said armature guide block.

16. The electromagnet according to claim 1, wherein said siphon is formed as a labyrinth.

17. A pressure valve with an electromagnet, said electromagnet comprising:

an armature guide block for guiding an armature movable around a control axis, a coil for receiving a current, said coil, with said current, producing a magnetic field to move the armature, a coil element for supporting said coil, a venting duct provided to vent said armature space and receive fluid formed therein, a siphon provided in said venting duct for siphoning the fluid from said venting duct away from said coil, and a direction of siphoning in said venting duct is formed toward said siphon, and at least partially concentrically, helically and/or spirally in relation to a movement of direction of said armature.

* * * * *